US009816774B2

(12) United States Patent
Cuddeback

(10) Patent No.: US 9,816,774 B2
(45) Date of Patent: Nov. 14, 2017

(54) RETRACTABLE GUN STAND

(71) Applicant: cFish, LLC, De Pere, WI (US)

(72) Inventor: Mark J. Cuddeback, Green Bay, WI (US)

(73) Assignee: cFish, LLC, De Pere, WI (US)

( * ) Notice: Subject to any disclaimer, the term of this patent is extended or adjusted under 35 U.S.C. 154(b) by 0 days.

(21) Appl. No.: 15/225,194

(22) Filed: Aug. 1, 2016

(65) Prior Publication Data

US 2016/0334182 A1 Nov. 17, 2016

Related U.S. Application Data

(63) Continuation of application No. 13/827,956, filed on Mar. 14, 2013, now Pat. No. 9,423,199.

(51) Int. Cl.
*E04H 12/18* (2006.01)
*F41A 23/06* (2006.01)

(52) U.S. Cl.
CPC ..... *F41A 23/06* (2013.01); *E04H 12/185* (2013.01)

(58) Field of Classification Search
CPC ..... F41A 23/16; F41A 23/02; F41A 23/04; F41A 23/10; E04H 12/185
USPC ..... 52/108
See application file for complete search history.

(56) References Cited

U.S. PATENT DOCUMENTS 1,147,890 A 7/1915 Purcell
2,956,795 A * 10/1960 Foster ..... F16F 1/10 185/37
3,583,322 A 6/1971 Vykukal
3,625,563 A 12/1971 Dickinson
3,666,220 A 5/1972 Rider
3,822,874 A 7/1974 Snyder
3,860,041 A 1/1975 Leiter
3,870,263 A 3/1975 Hardiman
3,890,907 A * 6/1975 Peterson ..... A47B 9/02 108/136
4,135,626 A 1/1979 Cawood
4,553,726 A 11/1985 Jackson
4,601,246 A 7/1986 Damico
(Continued)

FOREIGN PATENT DOCUMENTS

WO 2007/053694 A2 5/2007
WO 2007/053694 A3 5/2007

*Primary Examiner* — Reginald Tillman, Jr.
(74) *Attorney, Agent, or Firm* — Michael Best & Friedrich LLP

(57) ABSTRACT

A retractable stand comprises a base and two ribbons. Each ribbon has a coiled portion and an uncoiled portion. The uncoiled portions of the ribbons have a curved cross-sectional shape and are positioned in opposing relation to each other. Preferably, the curved cross-sectional shape of each uncoiled portion defines a convex surface and a concave surface, and the convex surfaces are in facing relation to each other. In one embodiment, the retractable stand further comprises a foot brace secured to free ends of the ribbons. Preferably, the foot brace includes an arm movable relative to the ribbons. The present invention further provides a method of supporting a device above a surface using the above retractable stand. The method includes uncoiling the two ribbons, resting the brace on the surface, and supporting the device on the retractable stand. Preferably, the step of uncoiling includes moving the brace away from the base.

19 Claims, 11 Drawing Sheets

(56) References Cited

U.S. PATENT DOCUMENTS

| | | | | |
|---|---|---|---|---|
| 4,616,218 | A | 10/1986 | Bailey | |
| 4,807,836 | A | 2/1989 | Price | |
| 4,922,836 | A | 5/1990 | Damico | |
| 5,056,278 | A * | 10/1991 | Atsukawa | E04H 12/185 248/161 |
| 5,221,009 | A | 6/1993 | Ritzenthaler | |
| 5,507,111 | A | 4/1996 | Stinson et al. | |
| 5,549,264 | A * | 8/1996 | West | F16M 11/42 248/157 |
| 5,842,284 | A | 12/1998 | Goldman | |
| 6,249,986 | B1 | 6/2001 | Murray | |
| 7,380,486 | B1 | 6/2008 | Bean | |
| 7,500,328 | B1 | 3/2009 | Bean | |
| 7,891,145 | B1 * | 2/2011 | Bobbio | E04H 12/185 242/379.2 |
| 7,954,271 | B1 | 6/2011 | Bentley | |
| 8,016,350 | B2 | 9/2011 | Dellano | |
| 8,104,313 | B2 | 1/2012 | Wolfe | |
| 9,162,362 | B2 * | 10/2015 | Saito | B25J 9/104 |
| 2009/0039211 | A1 | 2/2009 | Hsu | |
| 2011/0024596 | A1 | 2/2011 | Kephart | |
| 2011/0265367 | A1 | 11/2011 | Saunders, III | |

* cited by examiner

RETRACTABLE GUN STAND

BACKGROUND

The present invention relates generally to gun accessories and specifically to supports on which guns can be rested while shooting.

In order to increase the accuracy of aiming a gun, the gun can be rested upon a gun stand, often called a shooting stick. Gun stands come in a variety of different styles, such as a tripod, bipod, or monopod. Gun stands can be structurally separate from the gun or they can be attached (e.g., hinged) to the gun in a retracted or stored position to facilitate quick deployment of the gun stand.

SUMMARY

The present invention provides a retractable stand comprising a base adapted to support a device, and two ribbons. The device can include a rifles, pistols, still cameras, video cameras, cross bows, or other devices to be supported. Each ribbon has a coiled portion and an uncoiled portion, and the uncoiled portions of the ribbons have a curved cross-sectional shape and are positioned in opposing relation to (e.g., engaging) each other. The base can comprise a housing that substantially entirely encloses the coiled portions of the two ribbons. Preferably, the curved cross-sectional shape of each uncoiled portion defines a convex surface and a concave surface, and the convex surfaces of the uncoiled portions of the ribbons are in facing relation to each other.

In one embodiment, the stand further comprises a foot brace secured to free ends of the ribbons. Preferably, the foot brace includes an arm movable relative to the ribbons.

The present invention further provides a method of supporting a device above a surface using a retractable stand having a base, two ribbons each having a coiled portion and an uncoiled portion, and a brace connecting free ends of the uncoiled portions. The method includes uncoiling the two ribbons, resting the brace on the surface, and supporting the device on the retractable stand. Preferably, the step of uncoiling includes moving the brace away from the base (e.g., increasing a length of the uncoiled portions). The step of uncoiling can also include positioning the uncoiled portions in opposing relation to each other (e.g., arranging convex surfaces of the uncoiled portions in facing relation to each other). If desired, the base can include a housing that substantially entirely encloses the coiled portions of the two ribbons, and the uncoiling step can include increasing a length of the uncoiled portions extending outside the housing.

In one embodiment, the retractable stand has a foot brace secured to free ends of the ribbons, and the method further comprises holding the foot brace in contact with a supporting surface (e.g., moving an arm of the foot brace from a retracted position to an extended position).

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
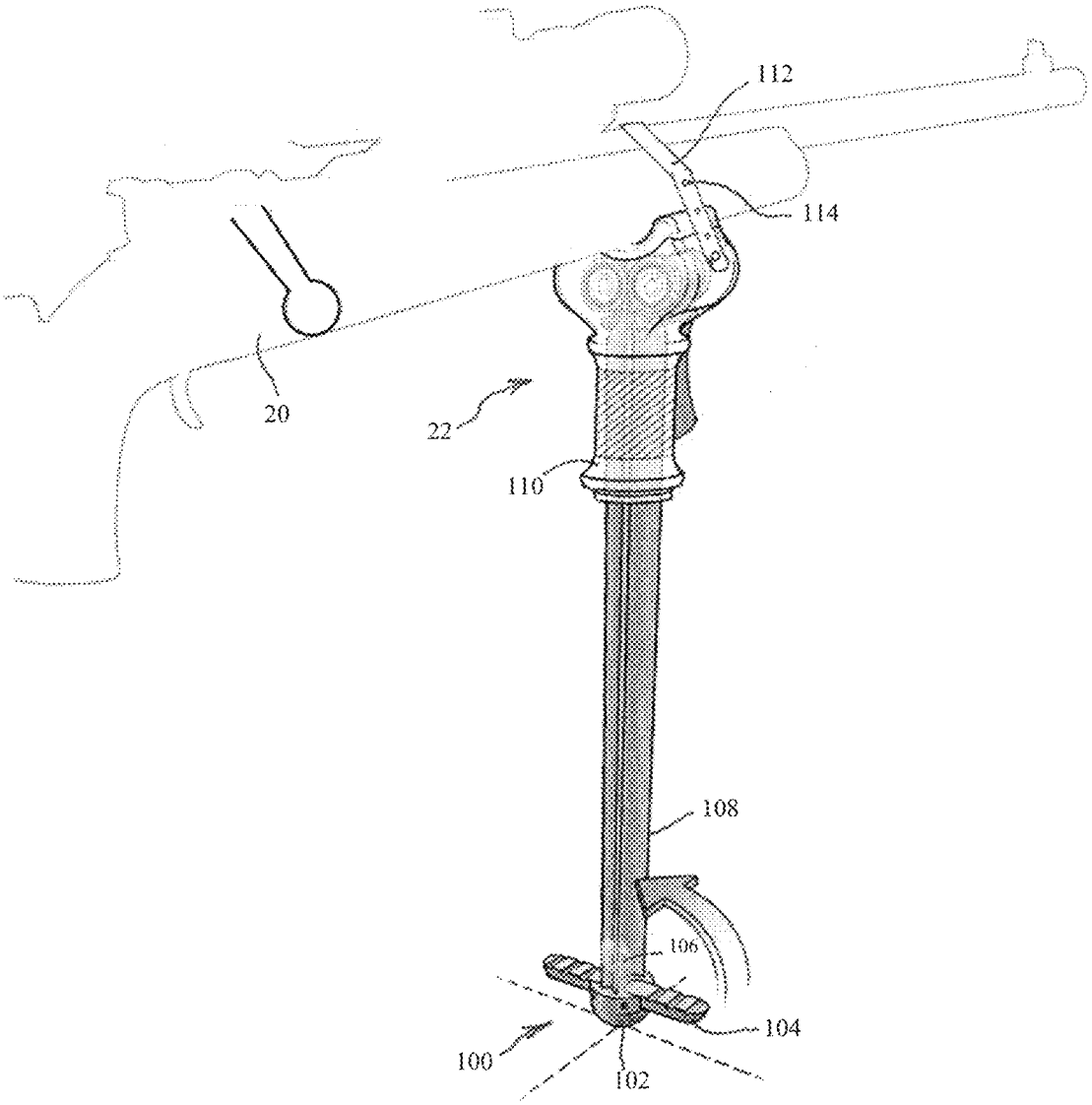
FIG. 1 illustrates a gun being supported by a retractable gun stand embodying the present invention.
Figure 2:
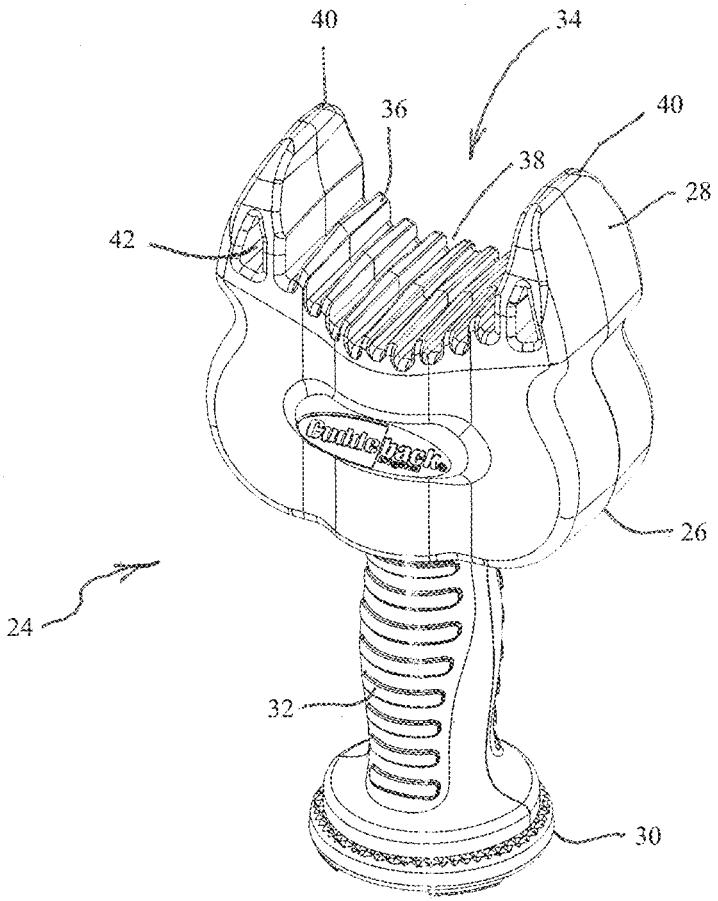
FIG. 2 is a perspective view of a second embodiment of the retractable gun stand.
Figure 3:
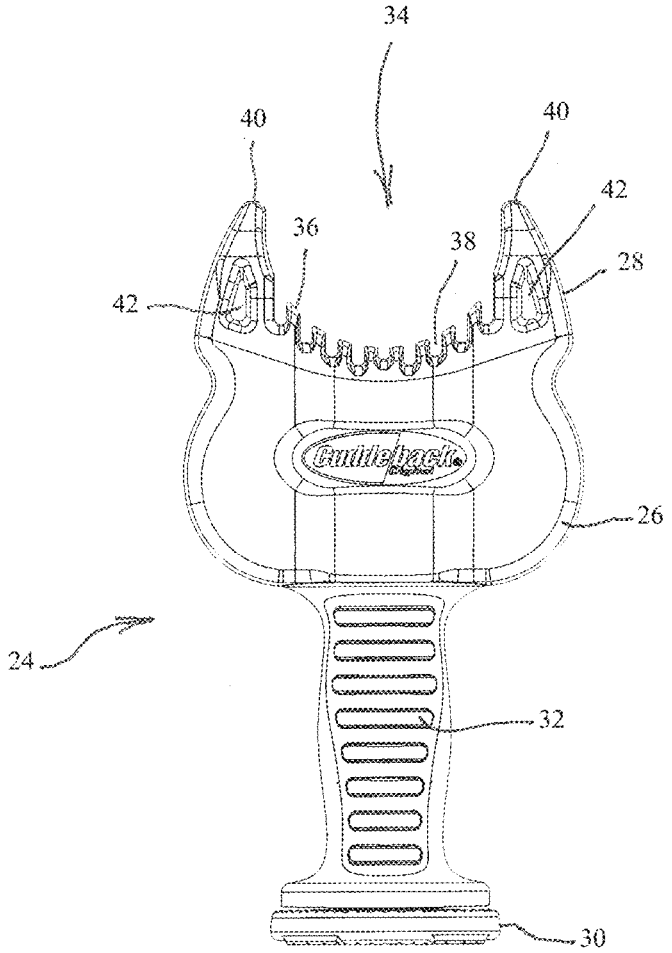
FIG. 3 is a front view of the gun stand illustrated in FIG. 2 with a foot brace in a retracted position.

FIG. 1 illustrates a gun 20 being supported by a gun stand 22 to thereby create a gun and gun stand assembly. The gun 20 can be any of numerous different types of guns, such as a rifle or a handgun.

A different gun stand 24 is illustrated in more detail in FIGS. 2-11. The illustrated gun stand 24 includes a housing 26 (including a front portion 26*a* and a rear portion 26*b*), an upper support 28, and a foot brace 30. The housing 26 includes a grip portion 32 and defines an enclosure for housing the movable components of the gun stand 24. The illustrated housing 26 is made from a rigid plastic material, although other materials could be used. If desired, the housing 26 can be formed as a single part.

The upper support 28 is secured to the upper surface of the housing 26. The upper support 28 defines a concave cradle 34 and is made from a soft resilience material (more resilient than the housing) that enhances the frictional contact between the gun and the gun stand 24. The upper support 28 includes a plurality of longitudinal ribs 36 separated by channels 38, and further includes side supports 40 that limit lateral movement of the gun relative to the gun stand 24. Each side support 40 includes an opening 42 extending longitudinally through the side support 40 to reduce the weight of the gun stand 24 and also increase the resiliency of the side support 40.

Figure 4:
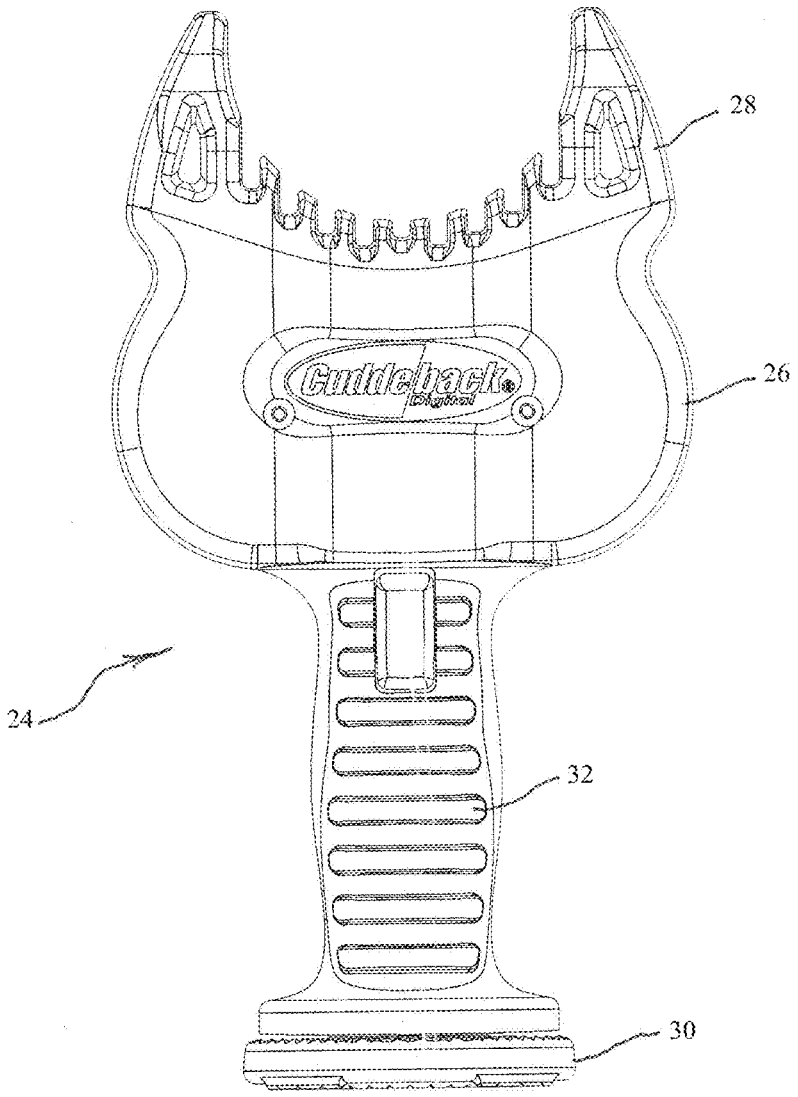
FIG. 4 is a rear view of the gun stand illustrated in FIG. 2.
Figure 5:
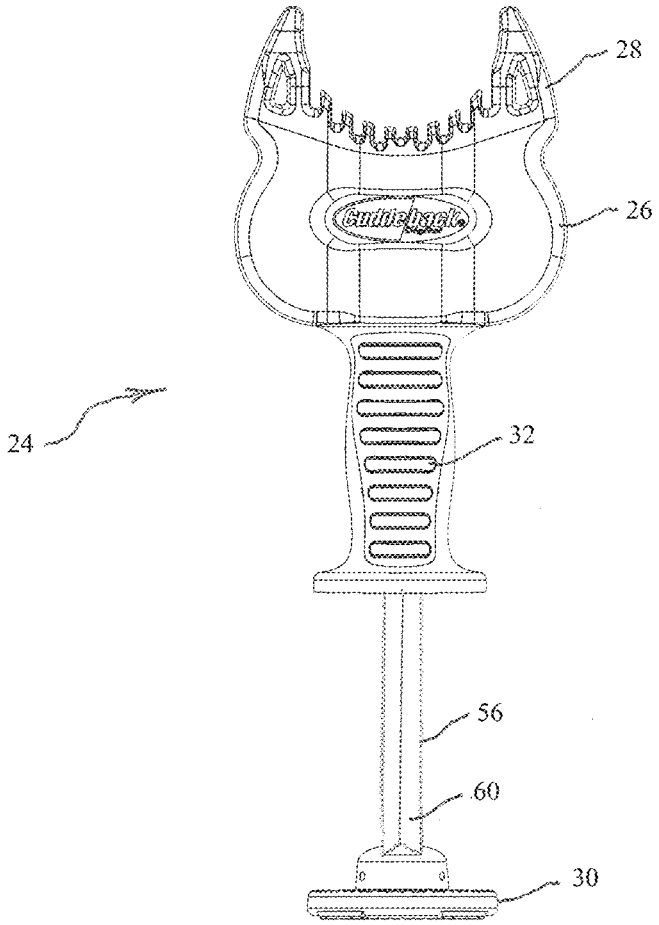
FIG. 5 is a front view of the gun stand illustrated in FIG. 2 with the foot brace in an extended position.
Figure 6:
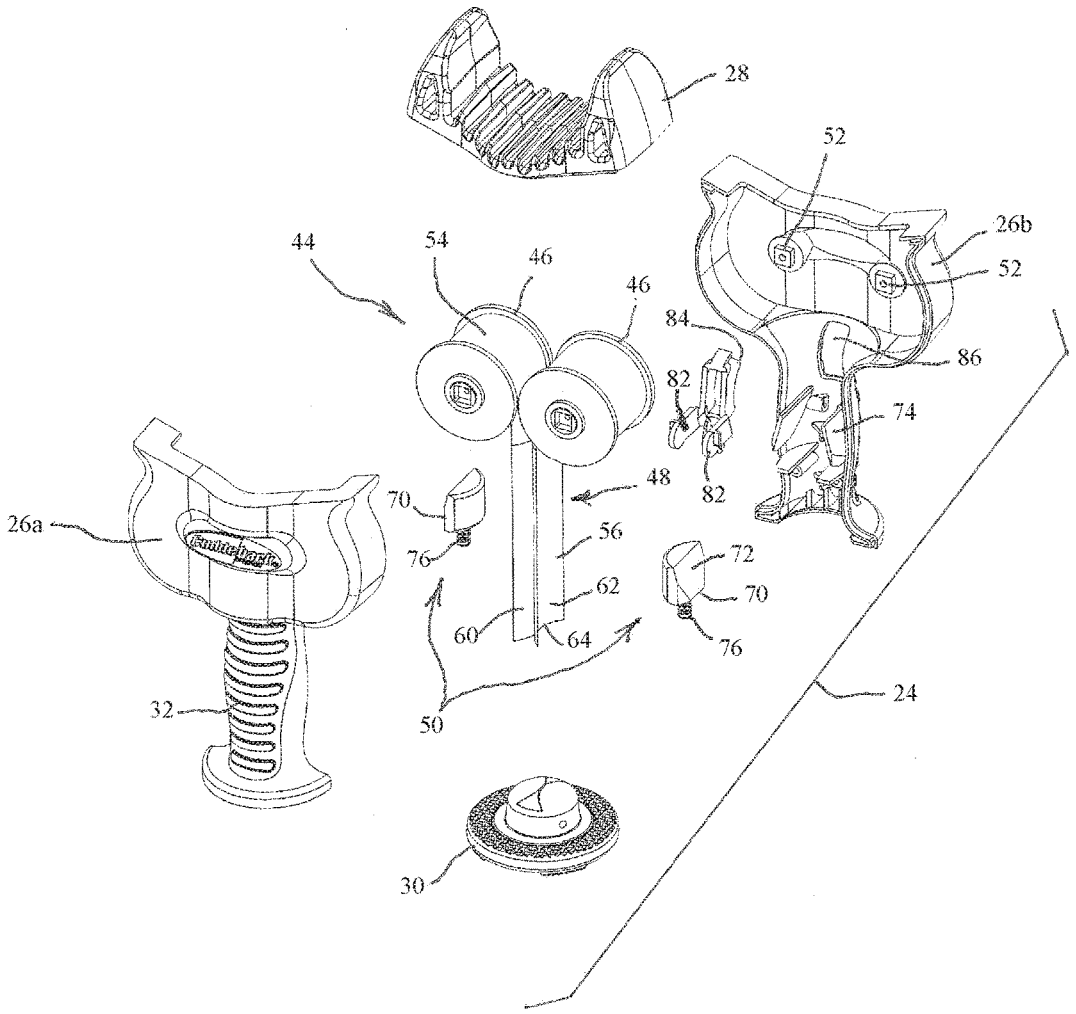
FIG. 6 is an exploded perspective view of the gun stand illustrated in FIG. 2.
Figure 7:
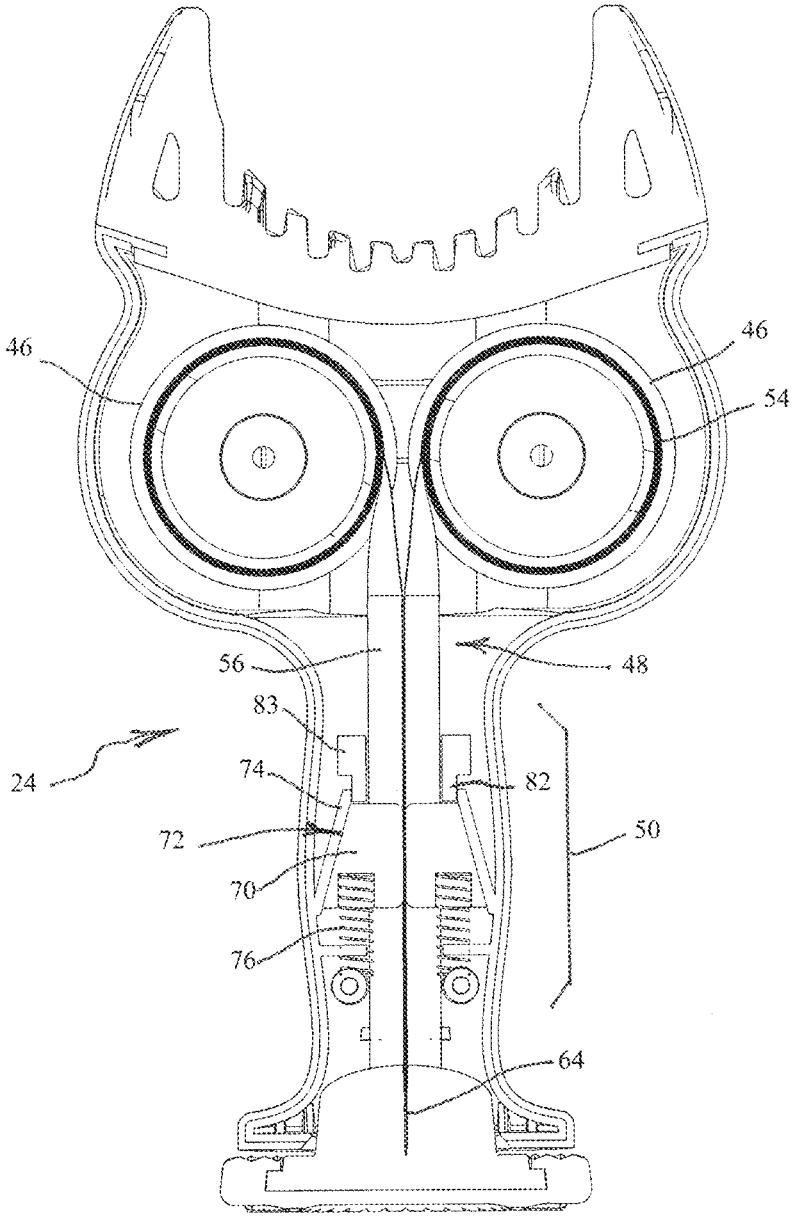
FIG. 7 is a perspective view taken along line 7-7 in FIG. 2.
Figure 8:
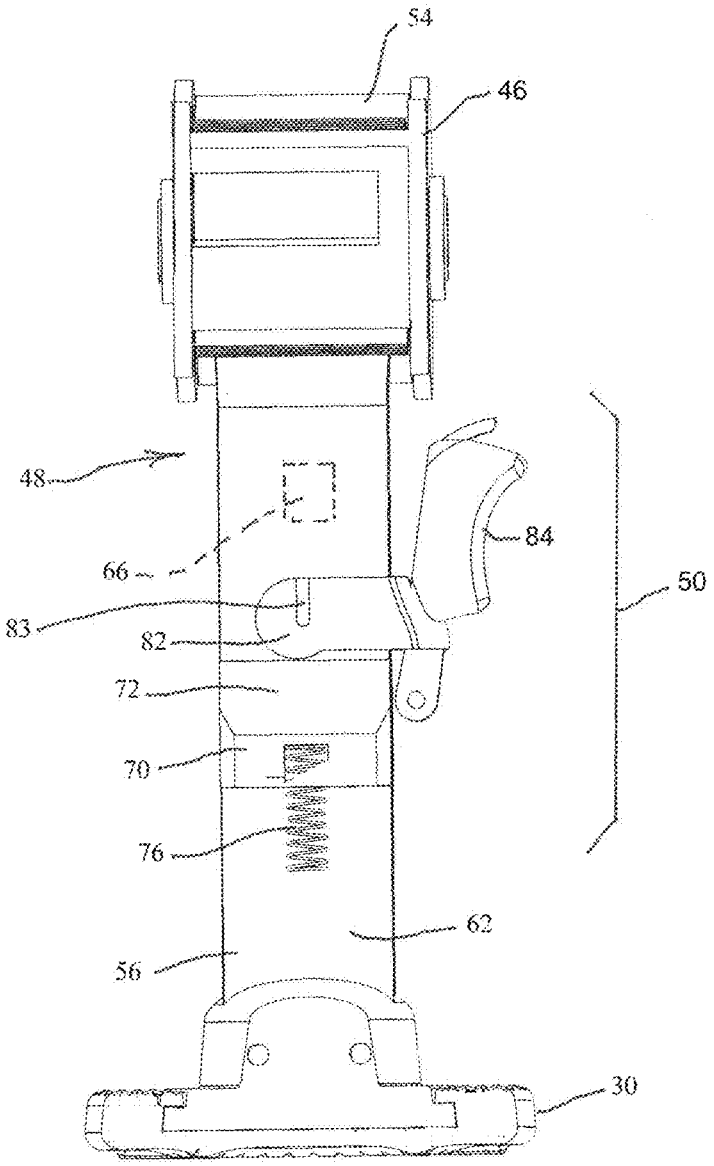
FIG. 8 is a section view taken along line 8-8 in FIG. 2 with a front housing, a rear housing, and an upper support removed for clarity.
Figure 9:
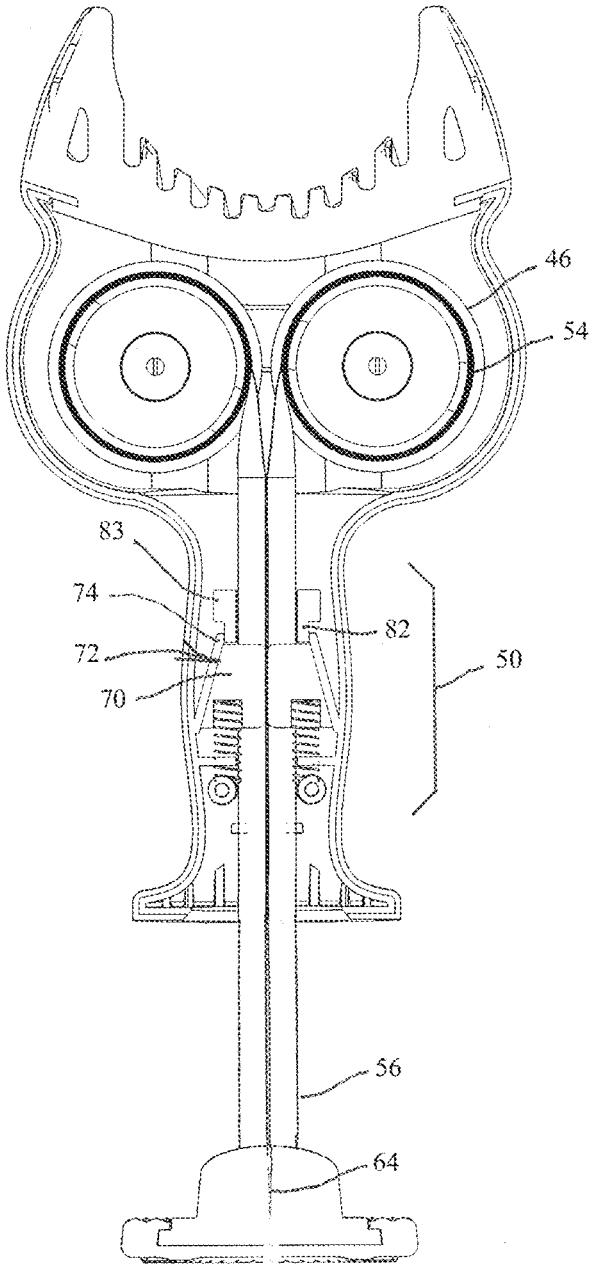
FIG. 9 is the section view of FIG. 7 with the foot brace in the extended position and the locking mechanism in a locked position.

Referring to FIGS. 4-6, the foot brace 30 can be moved relative to the housing 26 from a retracted position (FIG. 4) to an extended position (FIG. 5). This movement is facilitated by a tape spring mechanism 44 (FIG. 6).

Referring to FIGS. 6-10, the tape spring mechanism 44 includes left and right spools 46, left and right ribbons 48 coiled onto the spools, and a locking mechanism 50 that selectively locks and releases the ribbons 48.

Each spool 46 is supported on each end by mounting bosses 52 formed on the inside surface of the housing 26. If desired, each spool 46 can be designed to be rotatable relative to the housing 26 to thereby facilitate winding and unwinding the corresponding ribbon 48. Alternatively, the spool 46 can be rigidly secured in the housing 26, in which case the ribbon 48 will be loosely coiled around the spool 46. Each spool 46 is completely enclosed within the housing 26 and upper support 28.

Each ribbon 48 is a thin-walled ribbon of steel having a coiled portion 54 wrapped onto the corresponding spool 46 and a straight portion 56 extending from the corresponding spool 46. Each straight portion 56 corresponds with a static (non-stressed) condition of the ribbon 48 and has a curved lateral cross-sectional shape defining a convex surface 60 and a concave surface 62. Each coiled portion 54 corresponds with a stressed condition of the ribbon and has a flatter lateral cross-sectional shape. Each ribbon and spool assembly operates on the same principles as a tape measure. In the illustrated embodiment, the convex surface 60 of each straight portion 56 is in a facing orientation relative to the other straight portion 56, although other orientations (e.g., concave surfaces facing each other) are also possible. A free end 64 of each straight portion 56 is secured to the foot brace 30. Due to this arrangement of parts, each ribbon 48 will be uncoiled from the corresponding spool 46 at substantially the same rate as the other ribbon 48.

The illustrated ribbons 48 are arranged to be biased in the coiled direction so that they will automatically wind onto the spools 48 when the locking mechanism 50 is released. For example, if the spools 46 are rotatable, the spools 46 can be biased in a winding direction by a torsion spring. This is advantageous in that it facilitates quick and easy retraction of the ribbons 48 using a single hand. Alternatively, the ribbons 48 can be arranged to be biased in the uncoiled direction so that they will automatically unwind off the spools 48 when the locking mechanism 50 is released. This is advantageous in that it facilitates quick and easy deployment of the foot brace 30 using a single hand when use of the gun stand 24 is desired. This second arrangement further facilitates adjustment of the height of the gun stand 24 without the need to push down on the foot brace 30.

At least one of the ribbons 48 includes a releasable securing mechanism for securing the straight portions 56 of the ribbons 48 to each other. For example, one of the ribbons 48 can be provided with a magnetic material 66 (FIG. 8) embedded into or secured onto the ribbon 48 that will attract the metallic material of the other ribbon 48 to thereby enhance the stability of the gun stand 24. Other releasable securing mechanisms, such as hook and loop fasteners (e.g., Velcro® brand) or zippers could be used instead.

The locking mechanism 50 includes wedge-shaped locking members 70 positioned on opposing sides of each straight portion 56 of the each ribbon 48. Each locking member 70 is movable vertically relative to the housing 26. As each locking member moves upward (toward the upper support 28) relative to the housing 26, a cam surface 72 of the locking member 70 engages an angled guide member 74 on the housing 26 to thereby force the locking member 70 into contact with the corresponding ribbon 48. Because of the alignment of the locking members 70 with each other, any force applied by a locking member 70 on the ribbon 48 is opposed by an opposite force applied by the other locking member 70 on the other ribbon 48. A biasing member in the form of a coil spring 76 biases each locking member 70 in the upward direction into contact with the corresponding guide member 74 and ribbon 48. Absent additional forces on the locking members 70, upward movement of the straight portions 56 of the ribbons 48 is substantially prevented due to the locking members 70 being wedged between the guide members 74 and the ribbons 48. Downward movement of the straight portions 56 of the ribbons 48 is permitted because such movement of the ribbons 48 does not create the wedge effect caused by the locking members 70.

Figure 10:
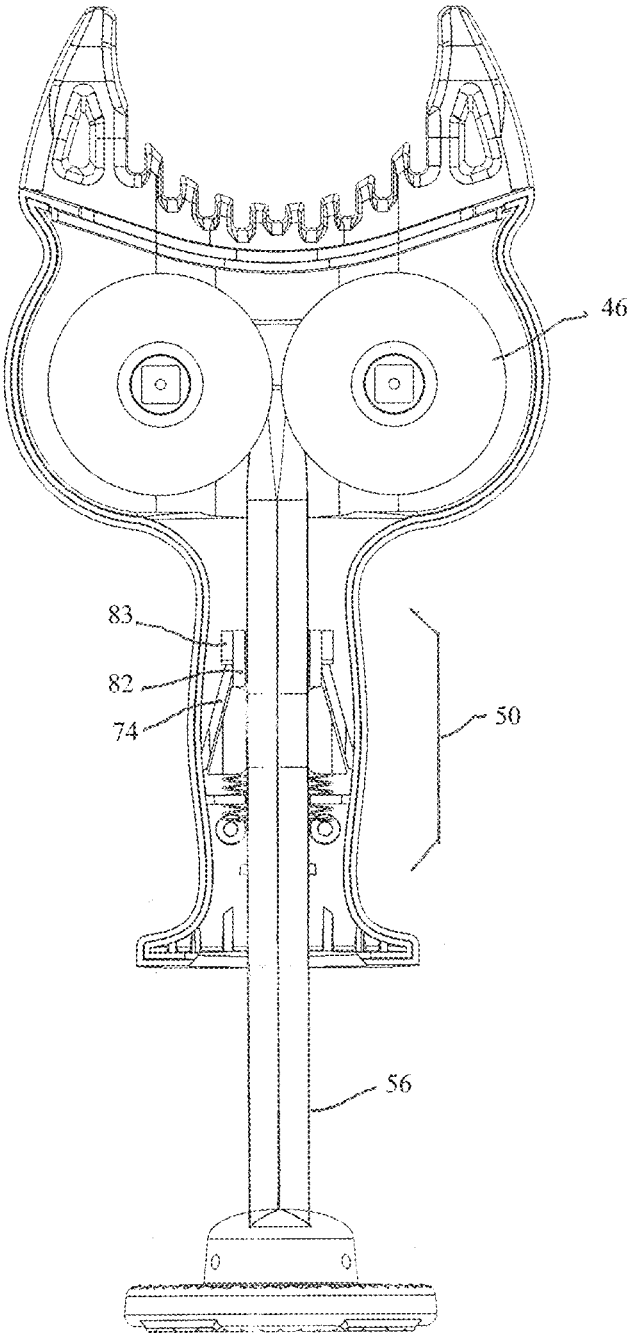
FIG. 10 is the section view of FIG. 9 with the foot brace in the extended position and the locking mechanism it in a released position.

The locking mechanism 50 further includes a release mechanism that releases the locking members 70 and facilitates retraction (upward movement) of the ribbons 48. The release mechanism includes release members 82 that are movable (e.g., pivotable) relative to the housing 26 between a locked position (FIG. 9) and a released position (FIG. 10). In the locked position, the release members 82 are inactive and have no effect on the locking members 70. In the released position, the release members 82 are moved downward into contact with the locking members 70 to thereby move the locking members 70 downward against the biasing force of the springs 76. This downward movement of the locking members 70 prevents the locking members 70 from assuming the wedged position, thereby allowing the ribbons 48 to move upward and coil onto the spools 46. Each release member 82 includes a stop member 83 engageable with the corresponding guide member 74 to limit downward movement of the release members 82.

Movement of the release members 82 between the locked position and the relaxed position is facilitated by a trigger 84 that extends through an opening 86 in the front portion **26*a* of the housing 26. The trigger 84 is formed integrally with the release members 82 such that squeezing of the trigger 84 will cause rotation of the release members 82** from the locked position to the released position.

Figure 11:
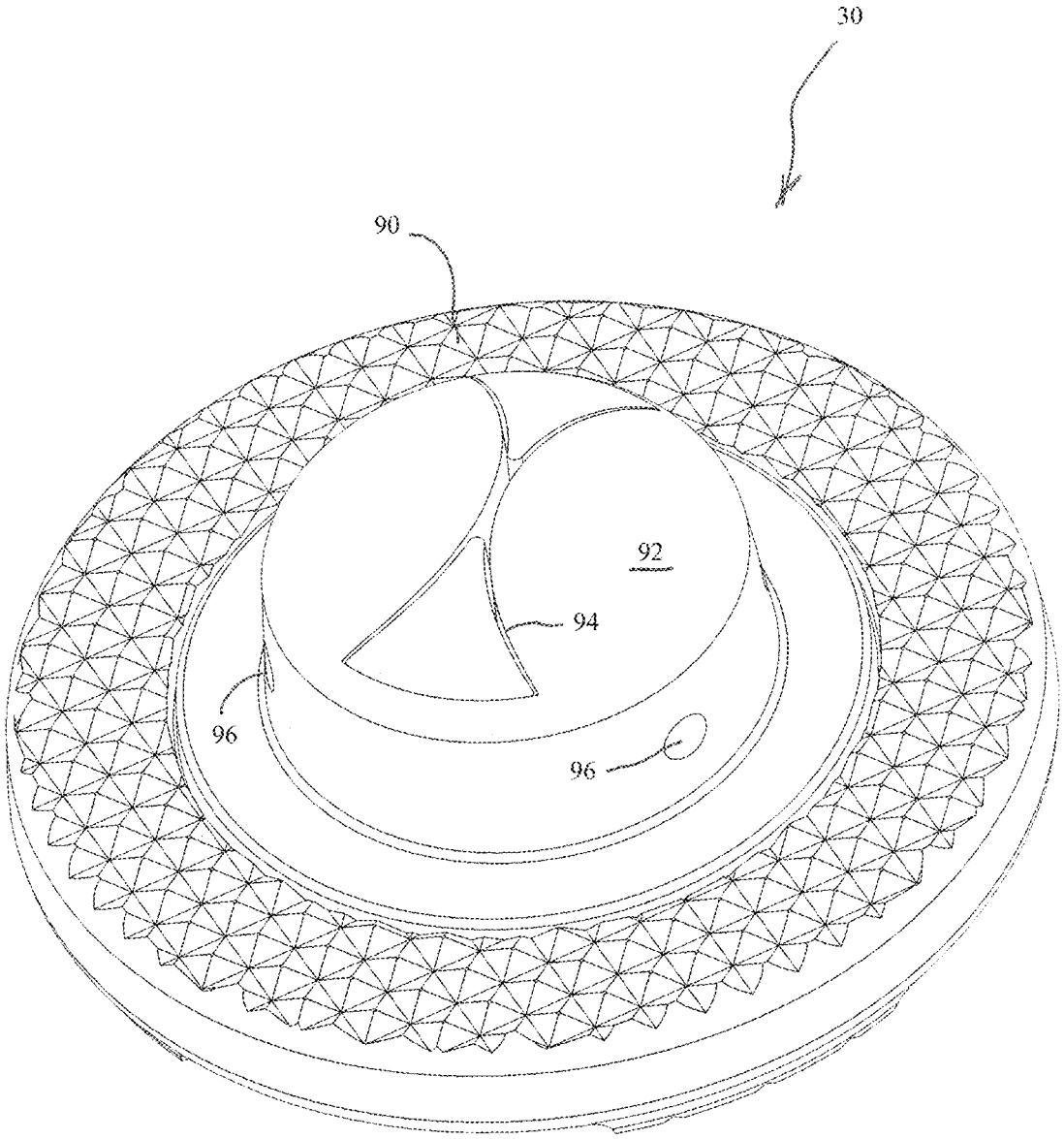
FIG. 11 is an enlarged perspective view of the foot brace.

Referring to FIG. 11, the illustrated foot brace 30 is a disc-shaped member having an engagement surface 90 that is roughened (e.g., knurled) to increase the frictional engagement of a users boot with the foot brace 30. The foot brace 30 includes a center portion 92 that is raised and includes two arcuate-shaped slots 94 extending longitudinally into the upper surface of the center portion 92. Each slot 94 is shaped to receive the free end 64 of one of the ribbons 48. Each side of the center portion 92 includes to openings 96 that are dimensioned to receive fasteners (e.g., setscrews, bolts, pins, or other suitable fastener) for securing the foot brace 30 to the ribbons 48.

In operation, use of the gun stand 24 is initiated by pulling the foot brace 30 downward relative to the housing 26, thereby causing the ribbons 48 to be uncoiled from the spools 46. If desired, the trigger 84 can be pressed to decrease the effort required to move the foot brace 30. The foot brace 30 is then contacted the ground, and the users foot is placed on the engagement surface 90 to hold the foot brace 30 in engagement with the ground. The height of the upper support 28 can then be adjusted (with or without the gun 20 resting in the upper support 28) by moving the housing 26 upward (with or without the trigger 84 pressed) or downward (while pressing the trigger 84). When the desired height is achieved, the trigger 84 is released. When it is desired to collapse the gun stand 24, the trigger 84 is pressed, thereby causing the ribbons 48 to retract into the housing 26 and causing the foot brace 30 to move toward the housing 26 and into the retracted position.

An alternative configuration for the foot brace is illustrated in FIG. 1. The alternative foot brace 100 includes a base 102 and a folding arm 104 that can be pivoted relative to the base 102 from and unfolded position (as illustrated in FIG. 1) to a folded position. In the folded position, each arm 104 is substantially aligned with and resides within a cavity 106 defined by the curved shape of one of the ribbons 108. This folded position of the arms 104 facilitates retraction of the foot brace 100 into the housing 110 by allowing the folded arms 104 to fit inside the lower opening of the housing 110 through which the ribbons 108 extend.

The gun stand 22 illustrated in FIG. 1 further includes a securing mechanism in the form of an adjustable strap 112 that secures the gun stand 22 to the gun 20. The strap 112 wraps over the top of the gun 20 and is secured to both sides of the housing 110. At least one end of the strap 112 includes multiple openings 114 for adjusting the effective length of the strap 112. Preferably, the strap 112 is made from a resilient material that can be tensioned when it is securing the gun 20 to the gun stand 22. Such a securing mechanism inhibits movement of the gun 20 relative to the gun stand 22, and further allows the gun stand 22 to stay attached to the gun 20 when the foot brace 100 is in the retracted position (e.g., when the gun 20 is not being operated). Such an arrangement facilitates quick and easy deployment of the gun stand 22.

Thus, the invention provides, among other things, a gun stand that is compact, lightweight, retractable, and can be easily deployed in the field. It should be understood that the above described stand can be used to support rifles, pistols, still cameras, video cameras, cross bows, or other similar devices. Various features and advantages of the invention are set forth in the following claims.

The invention claimed is:

1. A retractable stand comprising:

a base adapted to support a device;

two ribbons, each having a coiled portion and an uncoiled portion, wherein the uncoiled portions of the ribbons have a curved cross-sectional shape and are positioned in opposing relation to each other;

wherein the base includes a housing that substantially entirely encloses the coiled portions of the two ribbons;

wherein the curved cross-sectional shape of each uncoiled portion defines a convex surface and a concave surface, and wherein the convex surfaces of the uncoiled portions of the ribbons are in facing relation to each other; and wherein the uncoiled portions of the two ribbons engage with each other; and a locking mechanism that selectively locks and releases at least one of the ribbons relative to the base.

2. A retractable stand as claimed in claim 1, wherein at least one of the ribbons includes a releasable securing mechanism for securing the uncoiled portions of the ribbons to each other.

3. A retractable stand as claimed in claim 2, wherein releasable securing mechanism comprises a magnetic material.

4. A retractable stand as claimed in claim 1, further comprising a foot brace secured to free ends of the ribbons.

5. A retractable stand as claimed in claim 4, wherein the foot brace includes an arm movable relative to the ribbons.

6. A retractable stand as claimed in claim 1, further comprising a releasable attachment mechanism adapted to secure the device to the retractable stand.

7. A retractable stand as claimed in claim 6, wherein the releasable attachment mechanism comprises a strap.

8. A retractable stand as claimed in claim 1, wherein the locking mechanism includes at least two wedge-shaped locking members.

9. A retractable stand as claimed in claim 8, wherein each of the wedge-shaped locking members includes a cam surface that is engaged with a corresponding angled guide member formed on the housing.

10. A retractable stand as claimed in claim 9, wherein the locking mechanism further includes a coil spring that biases the locking members into contact with the angled guide member and the two ribbons.

11. A retractable stand as claimed in claim 1, wherein retraction of the two ribbons is inhibited when the locking mechanism is in a locked position.

12. A retractable stand as claimed in claim 1, wherein extension of the two ribbons is permitted when the locking mechanism is in a locked position.

13. A retractable stand as claimed in claim 1, wherein the locking mechanism further includes a release mechanism with a release member that is movable relative to the housing between a locked position and a released position.

14. A retractable stand as claimed in claim 13, wherein the release member contacts the locking members to move the locking members away from the two ribbons when the release members are in the released position.

15. A retractable stand as claimed in claim 14, further comprising a trigger engageable by the user for moving the release member.

16. A retractable stand as claimed in claim 1, wherein the locking mechanism further includes a trigger to release the locking mechanism.

17. A retractable stand as claimed in claim 16, wherein the trigger extends through an opening in a front portion of the housing.

18. A retractable stand as claimed in claim 1, wherein the housing and the coiled portions of the two ribbons move with the base supporting the device.

19. A retractable stand as claimed in claim 1, wherein the locking mechanism is movable between a locked position and a released position, and wherein the locking mechanism is biased toward the locked position.

* * * * *